US007891790B2

(12) United States Patent
Nip

(10) Patent No.: US 7,891,790 B2
(45) Date of Patent: Feb. 22, 2011

(54) INK CARTRIDGE FOR COMPUTER PRINTER

(75) Inventor: Shui Kuen Nip, North Point (HK)

(73) Assignee: Powerful Way Limited, North Point (HK)

( * ) Notice: Subject to any disclaimer, the term of this patent is extended or adjusted under 35 U.S.C. 154(b) by 819 days.

(21) Appl. No.: 11/686,463

(22) Filed: Mar. 15, 2007

(65) Prior Publication Data

US 2008/0079789 A1 Apr. 3, 2008

(30) Foreign Application Priority Data

Sep. 30, 2006 (CN) ..... 2006 2 0065131 U

(51) Int. Cl.
*B41J 2/175* (2006.01)

(52) U.S. Cl. ..... 347/87

(58) Field of Classification Search ..... None
See application file for complete search history.

(56) References Cited

U.S. PATENT DOCUMENTS 5,534,898 A * 7/1996 Kashino et al. ..... 347/33
6,481,839 B1 * 11/2002 Ito ..... 347/86
6,893,118 B2 * 5/2005 Murakami et al. ..... 347/84

* cited by examiner

*Primary Examiner*—Manish S Shah
*Assistant Examiner*—Alexander C Witkowski
(74) *Attorney, Agent, or Firm*—Rabin & Berdo, P.C.

(57) ABSTRACT

The invention provides a disposable ink cartridge to be installed in an existing all-in-one printhead-ink cartridge to form an assembled segregated printhead-ink cartridge for use in a printer. The all-in-one printhead-ink cartridge has a printhead with a printhead chamber from which any cover and ink-absorbent materials have been removed. The disposable ink cartridge includes an ink cartridge body, an assembly-securement member and a cartridge seal holder. The ink cartridge body further includes a cartridge housing, a cartridge cover, at least one air vent cover, at least one ink-storing foam, at least one ink-filtering foam, at least one sealing member, which are integrated into one indivisible entity fitting into the chamber of the printhead. When the disposable cartridge runs out of ink, what is needed is just to replace the ink cartridge body without replacing the printhead and the assembly-securement member, thus making the originally disposable printhead repeatedly usable.

37 Claims, 1 Drawing Sheet

INK CARTRIDGE FOR COMPUTER PRINTER

FIELD OF THE INVENTION

The present invention relates to a segregated printhead-ink cartridge containing a printhead which is removably connected to the ink cartridge. More particularly, the present invention relates to an approach of connecting the ink cartridge to the printhead of inkjet printer.

BACKGROUND OF THE INVENTION

Current ink cartridges for inkjet printers can be generally divided into two categories based on the connection mode of the ink cartridge to the printhead. One category is the all-in-one printhead-ink cartridge having a printhead connected to the ink cartridge by non-removable means, wherein the printhead usually uses thermal inkjet printing technology and the ink is usually directly stored inside a printhead chamber with the cartridge cover non-removably connected to the printhead chamber by welding. After the ink inside the printhead chamber is depleted, the entire ink cartridge together with the printhead is required to be replaced, resulting in high costs both in manufacturing and in using the printing consumables. As a result, it causes not only unnecessary wastes but also environment pollution by large amount of this mixed electronic waste which is difficult to dispose of and recycle. The other category is a segregated printhead-ink cartridge having the printhead connected to the ink cartridge by removable means, wherein the printhead usually uses piezoelectric printing technology and the ink is stored inside an ink cartridge housing. After the ink inside the ink cartridge housing is depleted, what is needed is just to replace the ink cartridge. Although the printhead can be repeatedly used many times, with only the ink cartridge as a disposable consumable which has relatively low manufacture cost and use cost, the cost of replacing the printhead is high due to the fact that the cost of a printhead using the piezoelectric printing technology is much higher in comparison with that of the printhead using the thermal inkjet printing technology. The cost of replacing such type of printhead is typically about 50% of the total cost of the printer. Besides, replacing the printhead is more difficult since this can only be done by designated qualified technicians through the dismantlement of the printer.

In light of the problems existing in the all-in-one printhead-ink cartridges, ink cartridges which can be refilled with ink are already available in the market. However, very complicated techniques are required for the ink refill operation and it is often too difficult for ordinary users to master them. Furthermore, the following problems occur very often when performing such an operation: (1) chemical reactions occur between the added ink and the ink remaining inside the cartridge when these inks are not compatible, resulting in ink deterioration and even blockage of the printhead nozzles; (2) the printhead's contact-type electric circuits are easily polluted by the ink causing improper electrical contact and printhead failure; (3) the printhead is easily damaged by external impact forces during handling; and (4) after repeated refills of ink, more and more ink residues are deposited on the surfaces of both the ink-absorbent materials and the ink filters and these residues are difficult to be removed, therein resulting in blockage of the ink filters. Due to the existence of the aforementioned problems, the actual number of ink refills is quite limited. Therefore the use life of the printhead cannot be practically and effectively prolonged and the printing quality cannot be reliably assured. Sometimes printing cannot even be carried out.

Directed against the problems existing in the all-in-one printhead-ink cartridges, segregated printhead-ink cartridges are also available where the ink cartridge is connected to the printhead by removable means. The ink cartridge is disposable while the printhead can be recycled for re-use. However, when the printhead is connected to the ink cartridge at the first time, the printhead must be processed by means of a complicated mechanical method. Therefore, a complete set of printhead and ink cartridge provided by special manufacture must be used. This results in limited adaptability of the products. Besides, since the resilient sealing member used for connecting the ink-supply port of the ink cartridge to the ink channel of the printhead nozzles is dependent on a circular groove surrounding the cylindrical surface on the outside of the sealing member matching with the ink-outlet of the ink cartridge by a clearance-fit, the clearance-fit area is in an unsealed condition when no other external pressure is applied. Each corresponding surface in the fitting is in surface-to-surface contact and the sealing for such a contact requires not only smooth and flat contact surfaces, but also a large contact pressure. Therefore, problems may occur due to an unreliable sealing condition existing at the contacting surfaces between the sealing member and the ink cartridge or due to the difficulties in unloading and loading the ink cartridge resulting from the large contact pressure. Furthermore, due to the miniature semi-circular cross-section seal line existing on the external end surface of the sealing member, the welding edge of the ink filter within the printhead chamber, which contacts the said seal line, is very narrow and the contact formed is almost line-to-line. Consequently, a problem of mismatch in position would easily occur, resulting in an unreliable seal at the area where the sealing member is in contact with the welding edge. In addition to the aforementioned problems, since the ink cartridge is fixed within the printhead by means of locking the external raised ribs of the ink cartridge into the grooves on the inner walls of the printhead chamber and the all-around-completely-sealed ink cartridge and the walls of the printhead chamber are basically non-elastic, it is not only that it is extremely difficult to load the ink cartridge into the printhead chamber due to the difficulties in locking the said raised ribs into the said grooves, but also that it is even more difficult for the dismantlement due to more difficulties in removing the said raised ribs out of the said grooves. Ordinary users usually cannot perform these operations of dismantlement and assembly.

SUMMARY OF THE INVENTION

The object of the present invention is to transform an all-in-one printhead-ink cartridge having the connection of a ink cartridge to a printhead by non-removable means into an ink cartridge in which the ink cartridge and a printhead are removably connected to each other by a flexible means, through improving both the method to secure the ink cartridge within the printhead and the construction of sealing.

Another object of the present invention is to allow ordinary users to transform easily an all-in-one printhead-ink cartridge containing a printhead integrated with the ink cartridge into a segregated printhead-ink cartridge containing a printhead separable from the ink cartridge only with the aid of a disposable ink cartridge provided by special manufactures, in order to practically prolong the use life of the printhead to the maximum extent, to reduce the cost of manufacture and cost of using the printing consumables, as well as to reduce the amount of electronic waste.

The above-mentioned objects of the present invention are realized by the followings. After the cover and the internal ink-absorbent materials of an all-in-one printhead-ink cartridge are removed by simple processes, a disposable ink cartridge which can be removably connected to the printhead is installed within the printhead chamber (i.e. the now empty chamber that previously accommodated the internal ink-absorbent materials). The disposable ink cartridge comprises three parts, namely an ink cartridge body, an assembly-securement member and a cartridge seal holder. The ink cartridge body further comprises a cartridge housing, a cartridge cover, at least one air vent cover, at least one ink-storing foam, at least one ink-filtering foam, at least one sealing member, etc., which form an indivisible and disposable entity, with its outline dimensions correspondingly fitting to the inner dimensions of the printhead chamber. The said entity is installed and pressed securely inside the printhead chamber either by a separate assembly-securement outer cover or by at least one assembly-securement claw which is preferably an integral part of the ink cartridge body, so that the peripheral bottom surface of the sealing member which is located at the ink outlet of the ink cartridge body is closely pressed against the welding frame of the ink filter of the printhead. The sealing member, which is preferably made of elastic material such as silicon rubber, is a sleeve structure having stepped apertures. The end with a larger diameter aperture is tightly pressed into a groove surrounding the ink outlet of the ink cartridge body in an interference-fit manner in order to ensure that a reliable sealing condition is always maintained on the side where the seal member contacts with the ink cartridge body. At the other end where the sealing member contacts with the welding frame of the ink filter within the printhead chamber, the end face has a flat surface structure without a raised sealing ring so that a surface-to-line contact is formed between the end surface and the relatively narrow welding frame, resulting in a reliable seal.

The outer cover, which relies on rigid locking tabs locating on its lower side, is placed over the external frame edge of the printhead chamber and it can be moved back and forth in a straight line along the chamber edges. Thus, the outer cover is a functional element that can be separately installed or removed. The assembly-securement claw can be made of certain thermoplastic materials to become an elastic and long narrow rib claw structure with its inner side having locking tabs. The rib claw structure, relying on its elasticity, can be rotated within a certain range of angles in a plane perpendicular to the matching external frame edge of the printhead chamber so that its locking tabs can be flexibly locked in place.

The cartridge seal holder is an independent functional part, preferably with snapping-tabs on both sides that match grooves on two sides of the ink cartridge body. The sealing member located in the ink outlet of the ink cartridge body is tightly pressed into the cartridge seal holder. The cartridge seal holder is used to seal the ink outlet of the ink cartridge body when the ink cartridge body is not yet installed in the printhead chamber, and is removed when installing the ink cartridge body.

The resulting segmented printhead-ink cartridge not only has a reliable seal for the connection of the ink cartridge body with the printhead, but also other features. For example, the originally simple work to dismantle the all-in-one printhead-ink cartridge can be manually done by users themselves without the need of complicated mechanical processes. It is also very easy to install or remove the ink cartridge body and its assembly-securement member in or out of the printhead, and such an operation can be easily performed by ordinary users. When the disposable ink cartridge runs out of ink, what is needed is just to replace the ink cartridge body within the printhead, without the need of replacing the printhead and the outer cover. Therefore, the printhead can be repeatedly used, consequently extending the practical use life of the originally disposable printhead to the maximum, reducing the costs of manufacturing and using the printing consumables, and reducing the amount of electronic waste. Since only simple operations are required for dismantlement and modification, the possibility of impact or pollution of the electric contacts and the nozzles of the printhead is almost nonexistent. Due to the complete removal of the residue ink in the ink-absorbent materials inside the printhead following the replacement of the ink cartridge body, the problem of ink deterioration arising from ink mixing which occurs commonly in refilled ink cartridges can be avoided. Furthermore, in every ink cartridge body replacement, the ink filter is contacted and absorbed once by the ink-filtering foam which functions like a brush and is located at the ink outlet. As a result, the ink filter is cleaned every time the ink cartridge body is replaced. Accordingly, it reduces the possibilities of the ink filter surface being blocked by the deposits of ink residues, so that high quality of printing can be ensured.

In addition, in comparison with the prior-art ordinary segregated printhead-ink cartridge, because this kind of segregated printhead-ink cartridge is transformed from an all-in-one printhead-ink cartridge where the printhead uses the thermal inkjet printing technology, therefore, not only are the manufacturing cost and use cost of the printhead are much lower, but also the replacement of printhead is as simple and easy as replacing an ink cartridge body and can be done without any need of using professional personnel. As a result, the problems of difficulties in replacing the piezoelectric printhead used in the original segregated printhead-ink cartridge are avoided.

The disposable ink cartridge may be a single colour ink cartridge where the ink cartridge body includes a single air vent cover, a single ink-storing foam, a single ink-filtering foam and a single sealing member. However, the disposable ink cartridge may be a multi-colour ink cartridge with a single cartridge housing and a single cartridge cover but where the ink cartridge body includes a plurality of air vent covers, a plurality of ink-storing foams, a plurality of ink-filtering foams and a plurality of sealing members. An example of such a multi-colour ink cartridge would be one that has cyan, yellow and magenta ink in one ink cartridge body.

BRIEF DESCRIPTION OF THE DRAWINGS

Detailed structures of the present invention are shown in the following embodiments and drawings.

In these figures, the labels and their corresponding part names are:

"1" printhead,
"2" welding frame of an ink filter of the printhead,
"3" ink filter of the printhead,
"4" sealing member,
"5" ink-filtering foam,
"6" ink,
"7" ink-storing foam,
"8" cartridge housing,
"9" cartridge cover,
"10" air vent cover,
"11" outer cover,
"12" locking tab of outer cover,
"13" cartridge seal holder,
"14" cartridge-claw,
"15" locking tab of cartridge-claw,
"16" groove,
"17" external frame edge of the printhead, and
"18" groove.

DETAILED DESCRIPTION OF THE PREFERRED EMBODIMENTS

Figure 1:
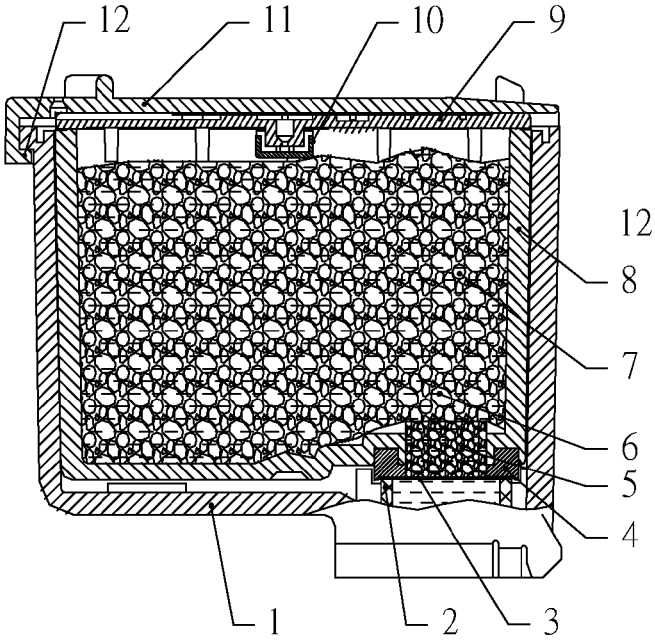
FIG. 1 is a longitudinal cross-sectional view along the center of the printhead nozzle of a segregated printhead-ink cartridge.
Figure 2:
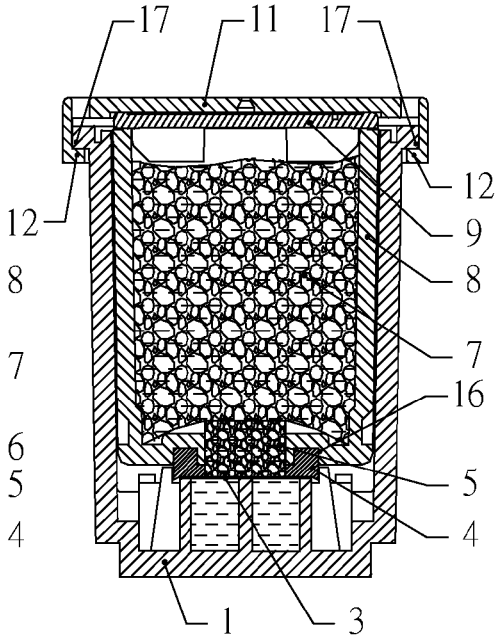
FIG. 2 is a lateral cross-sectional view along the center of the printhead nozzle of the printhead-ink cartridge depicted in FIG. 1.

Before the disposable ink cartridge of the present invention can be installed, it is first necessary to perform a simple process of removing the cartridge cover and the ink-absorbent materials from an ink depleted or a new all-in-one printhead-ink cartridge. Then, as shown in FIG. 1 and FIG. 2, it is possible to install inside the printhead chamber a disposable ink cartridge that can be connected to the printhead 1 by means of removable connections. The installed disposable ink cartridge and the printhead of the existing all-in-one printhead-ink cartridge together form a segregated printhead-ink cartridge that can be used in a printer. The disposable ink cartridge includes three parts: an ink cartridge body, an outer cover 11 and a cartridge seal holder 13. The ink cartridge body further mainly comprises a cartridge housing 8, a cartridge cover 9, an air vent cover 10, an ink-storing foam 7, an ink-filtering foam 5, a sealing member 4, etc., which together form an indivisible and disposable entity, with the outline dimensions fitting correspondingly to the inner dimensions of the chamber of the printhead 1. The sealing member 4, having a sleeve structure with stepped apertures, is made of soft and elastic materials such as silicon rubber. The sleeve wall of the upper end of the sealing member 4 which has a larger diameter aperture is tightly pressed by interference fit into an annular groove 16 surrounding the ink outlet of the disposable ink cartridge in order to ensure that a reliable sealing condition is achieved on the upper end face where the sealing member contacts with the ink cartridge body without the need of any other external applied pressure. (For the sake of easy assembly, proper chamfer angles can be made to the groove openings.) The opposite end face of the sealing member 4 contacts with the ink filter welding frame 2 and is of a flat surface structure without any miniature raised sealing ring of semi-circular cross section. When a small downward pressure is applied, a reliable seal can be formed in the contact area. As a result, when a relatively small locking assembly pressure is applied by a locking tab 12 of the outer cover 11 (FIG. 2) or a locking tab 15 of a cartridge-claw 14 (FIG. 4) to the external frame edge 17 of the printhead 1, then a leakage free and continuous ink supply passage can be established between the ink outlet of the ink cartridge and the ink channel of the printhead nozzle.

The outer cover 11 is an independent functional part and the dimensions of the six locking tabs 12 distributed around its lower inner sides match with that of the external frame edge 17 of the printhead 1. It can move back and forth in a straight line along the external frame edge 17 of the printhead shown in FIG. 2. When it moves to the limit position as shown in FIG. 1, it can fix the cartridge housing 8 in the printhead chamber and closely press the peripheral surface of the lower end face of the sealing member 4 in the ink outlet of the ink cartridge body against the welding frame 2 of the printhead ink filter 3.

Figure 4:
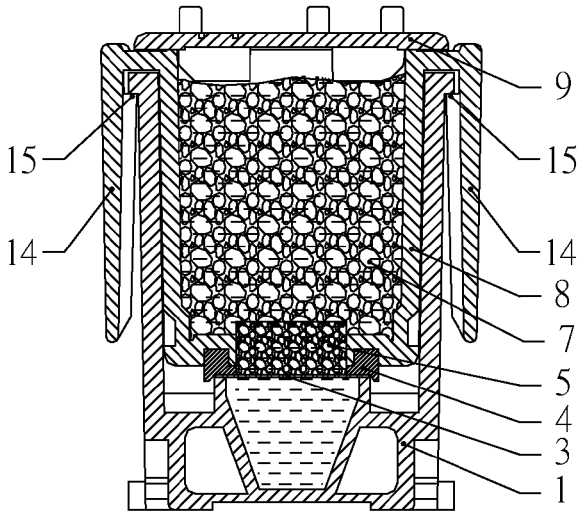
FIG. 4 is a lateral cross-sectional view along the centre of the printhead nozzle of a segregated print-ink cartridge with another type of assembly securement.

In another type of segregated printhead-ink cartridge containing a different type of assembly securement as shown in FIG. 4, the cartridge-claw 14, which has locking tabs 15 on the inner sides, is integrally molded with the cartridge housing 8 in polypropylene material and is an elastic with a long narrow rib claw structure. Each cartridge-claw, relying on its elasticity, can lead the locking tab 15 to rotate along its bottom within a certain range of angles in the plane shown in FIG. 4, so that the locking tab 15 can be locked into or removed from the external frame edge 17 of the printhead. The cartridge-claws 14 are configured to have a downward long rib structure and are meant to increase the length of the power arm in its lower part and reduce the force required by manual operation.

Figure 3:
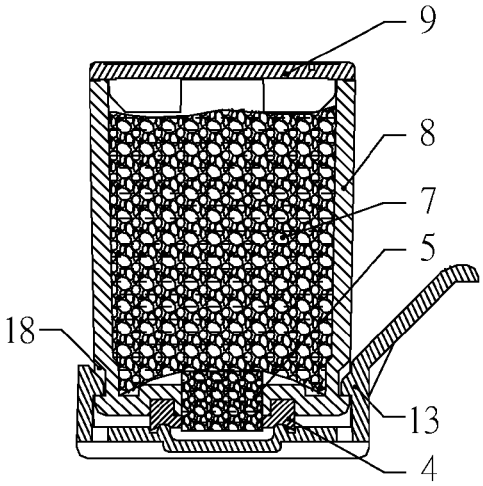
FIG. 3 is a cross-sectional view of the ink cartridge body depicted in FIG. 2 before removing the cartridge seal holder and before it is installed in a printhead.

The cartridge seal holder 13 is an independent functional part (shown in FIG. 3) and it is used to seal the ink outlet of the ink cartridge body before the ink cartridge body is assembled to the printhead chamber. There are claws on both sides of the cartridge seal holder 13 that match with grooves 18 on opposite sides of the cartridge housing 8. Thus the sealing member 4 located in the ink outlet of the ink cartridge body is tightly pressed into the cartridge seal holder 13 before it is removed. The cartridge seal holder 13 is removed when installing the ink cartridge body into the printhead chamber.

In FIG. 1, a disposable ink cartridge is already installed in the printhead chamber to form a segregated printhead-ink cartridge. At this time, the upper surface of the printhead ink filter 3 is closely contacted with the lower surface of the ink-filtering foam 5 of the ink cartridge body. The ink-filtering foam 5 is also closely contacted with the ink-storing foam 7 within the ink cartridge by compression so that the ink-storing foam at this region is more compact than other parts of the ink-storing foam located elsewhere. Because the ink-filtering foam 5 is more compact, the capillary in the ink-storing foam 7 around the ink-filtering foam of the ink cartridge body is smaller than that of the others, while the capillary in the ink-filtering foam is even smaller than the capillaries in the ink-storing foam above it. It will be readily appreciated that there is a general tendency for the liquid in capillaries to flow from a coarse region to a dense region due to the effect of surface tension of the liquid, that is to say, there is a pressure driving the liquid to flow from large capillary tubes to small capillary tubes. Therefore, the structure of the ink-storing and ink-filtering foams within the ink cartridge body is configured to ensure a possibility of a sufficient and smooth supply of ink to the ink filter 3 of the printhead and the underlying ink channel of the nozzle. When the printhead is not in operation, a state of static equilibrium is maintained between the external atmospheric pressure which comes from the air entering in turn from the inlet air vents of the outer cover 11 and the cartridge cover 9 through the air vent cover 10 into the cartridge housing 8 and having an effect on the upper surface of ink-storing foam 7, the downward weight of the ink 6 and the adsorption force to the ink due to the capillaries in the foams. As a result, the ink 6 contained in the ink cartridge body will not run off through the nozzle of the printhead.

When the printhead is in operation, the suction force from the printhead initially forms a relatively low pressure area located in the ink channel of the nozzle underneath the ink filter 3 of the printhead, and then, such a low pressure area quickly extends in turn to the ink-filtering foam 5 and the ink-storing foam 7. As a result, the original static equilibrium condition is broken and an ink flow within the ink cartridge takes place from the ink-storing foam 7 to the ink-filtering foam 5, and then to the ink channel of the nozzle through the ink filter 3 of the printhead.

When the ink inside the ink cartridge body is depleted causing significant fade to appear on the print-outs, the segregated printhead-ink cartridge is removed from the printer. The outer cover 11 is to be moved to the left side of FIG. 1 so that it is disengaged from the external frame edge 17 of the printhead The outer cover 11 can then be removed and subsequently the ink cartridge body can be taken out of the printhead. Then, the sealed packaging bag of a new disposable ink cartridge of the present invention can be opened and the replacement ink cartridge can be placed in the printhead chamber after the cartridge seal holder 13 has been removed. The segregated printhead-ink cartridge can then be installed in the printer after positioning and installing the outer cover 11 over the printhead chamber. Therefore, the original printhead can be continuously used in a normal way. By repeating such a cycle, a multiplicity of disposable ink cartridges can be replaced within an effective use life of a single printhead.

The invention claimed is:

1. A disposable ink cartridge for being installed in an existing all-in-one printhead-ink cartridge, the all-in-one printhead-ink cartridge having a printhead and a non-removable ink cartridge, the non-removable ink cartridge being unremovably connected to and within the printhead so as to be installed or removed together with the printhead, wherein from a printhead chamber formed inside the printhead of the all-in-one printhead-ink cartridge, any cover and ink-absorbent materials have been removed, the disposable ink cartridge comprising:

an assembly-securement member;

an ink cartridge body, the ink cartridge body comprising a cartridge housing, a cartridge cover, at least one air vent cover, at least one ink-storing foam, at least one ink-filtering foam, and at least one sealing member, which are integrated into one indivisible entity, the ink cartridge body being adapted to be installed in the printhead chamber of the printhead to transform the all-in-one printhead-ink cartridge into an assembled segregated printhead-ink cartridge for use in a printer, the installed ink cartridge body being secured by the assembly-securement member and reciprocatingly moving along with the printhead, the at least one sealing member being fixed on a side of the ink cartridge body, being used to seal around an ink outlet of the ink cartridge body and having an elastic sleeve structure with stepped apertures, with an upper sleeve wall tightly pressed into a groove surrounding the ink outlet of the ink cartridge body by means of interference fit between an upper end face of the sealing member and the ink cartridge body to maintain a continuous sealing condition between the sealing member, the ink cartridge body and a lower end face of the sealing member, the lower end face having a flat surface structure adapted to provide a reliable seal when tightly contacting the printhead, so that the ink outlet of the ink cartridge body is directly connected to the printhead; and a cartridge seal holder used to seal the ink outlet of the ink cartridge body before the ink cartridge body is installed in the printhead chamber of the printhead, so that the at least one sealing member seals an end surface of the ink outlet both before and after the ink cartridge body is installed in the printhead chamber of the printhead.

2. A disposable ink cartridge according to claim 1, wherein the assembly-securement member is an outer cover.

3. A disposable ink cartridge according to the claim 2, wherein the outer cover has at least one locking tab to match an external frame edge of the printhead to form a slidable assembly-securement structure which can be installed or removed independently.

4. A disposable cartridge according to claim 3, wherein the lower end face of the sealing member is without a raised sealing ring.

5. A segregated printhead-ink cartridge for use in a printer comprising a printhead having a printhead chamber and a disposable ink cartridge according to claim 4, wherein the disposable ink cartridge is installed in the printhead chamber of the printhead and secured by the assembly-securement member, and wherein the lower end face of the at least one sealing member is in contact with the printhead to provide a reliable seal.

6. A segregated printhead-ink cartridge for use in a printer comprising a printhead having a printhead chamber and a disposable ink cartridge according to claim 3, wherein the disposable ink cartridge is installed in the printhead chamber of the printhead and secured by the assembly-securement member, and wherein the lower end face of the at least one sealing member is in contact with the printhead to provide a reliable seal.

7. A disposable ink cartridge according to claim 3, wherein the assembly-securement member has at least one cartridge-claw integrated with the cartridge housing.

8. A disposable cartridge according to claim 7, wherein the lower end face of the sealing member is without a raised sealing ring.

9. A segregated printhead-ink cartridge for use in a printer comprising a printhead having a printhead chamber and a disposable ink cartridge according to claim 8, wherein the disposable ink cartridge is installed in the printhead chamber of the printhead and secured by the assembly-securement member, and wherein the lower end face of the at least one sealing member is in contact with the printhead to provide a reliable seal.

10. A segregated printhead-ink cartridge for use in a printer comprising a printhead having a printhead chamber and a disposable ink cartridge according to claim 7, wherein the disposable ink cartridge is installed in the printhead chamber of the printhead and secured by the assembly-securement member, and wherein the lower end face of the at least one sealing member is in contact with the printhead to provide a reliable seal.

11. A disposable ink cartridge according to claim 7, wherein the cartridge-claw has at least one locking-tab to match an external frame edge of the printhead to form a fixed structure which is in a form of a rotating arm and which is installed or removed together with the ink cartridge body.

12. A segregated printhead-ink cartridge for use in a printer comprising a printhead having a printhead chamber and a disposable ink cartridge according to claim 11, wherein the disposable ink cartridge is installed in the printhead chamber of the printhead and secured by the assembly-securement member, and wherein the lower end face of the at least one sealing member is in contact with the printhead to provide a reliable seal.

13. A disposable cartridge according to claim 11, wherein the lower end face of the sealing member is without a raised sealing ring.

14. A segregated printhead-ink cartridge for use in a printer comprising a printhead having a printhead chamber and a disposable ink cartridge according to claim 13, wherein the disposable ink cartridge is installed in the printhead chamber of the printhead and secured by the assembly-securement member, and wherein the lower end face of the at least one sealing member is in contact with the printhead to provide a reliable seal.

15. A segregated printhead-ink cartridge for use in a printer comprising a printhead having a printhead chamber and a disposable ink cartridge according to claim 2, wherein the disposable ink cartridge is installed in the printhead chamber of the printhead and secured by the assembly-securement member, and wherein the lower end face of the at least one sealing member is in contact with the printhead to provide a reliable seal.

16. A disposable cartridge according to claim 2, wherein the lower end face of the sealing member is without a raised sealing ring.

17. A segregated printhead-ink cartridge for use in a printer comprising a printhead having a printhead chamber and a disposable ink cartridge according to claim 16, wherein the disposable ink cartridge is installed in the printhead chamber of the printhead and secured by the assembly-securement member, and wherein the lower end face of the at least one sealing member is in contact with the printhead to provide a reliable seal.

18. A disposable ink cartridge according to claim 2, wherein the assembly-securement member has at least one cartridge-claw integrated with the cartridge housing.

19. A disposable cartridge according to claim 18, wherein the lower end face of the sealing member is without a raised sealing ring.

20. A segregated printhead-ink cartridge for use in a printer comprising a printhead having a printhead chamber and a disposable ink cartridge according to claim 19, wherein the disposable ink cartridge is installed in the printhead chamber of the printhead and secured by the assembly-securement member, and wherein the lower end face of the at least one sealing member is in contact with the printhead to provide a reliable seal.

21. A segregated printhead-ink cartridge for use in a printer comprising a printhead having a printhead chamber and a disposable ink cartridge according to claim 18, wherein the disposable ink cartridge is installed in the printhead chamber of the printhead and secured by the assembly-securement member, and wherein the lower end face of the at least one sealing member is in contact with the printhead to provide a reliable seal.

22. A disposable ink cartridge according to claim 18, wherein the cartridge-claw has at least one locking-tab to match an external frame edge of the printhead to form a fixed structure which is in a form of a rotating arm and which is installed or removed together with the ink cartridge body.

23. A segregated printhead-ink cartridge for use in a printer comprising a printhead having a printhead chamber and a disposable ink cartridge according to claim 22, wherein the disposable ink cartridge is installed in the printhead chamber of the printhead and secured by the assembly-securement member, and wherein the lower end face of the at least one sealing member is in contact with the printhead to provide a reliable seal.

24. A disposable cartridge according to claim 22, wherein the lower end face of the sealing member is without a raised sealing ring.

25. A segregated printhead-ink cartridge for use in a printer comprising a printhead having a printhead chamber and a disposable ink cartridge according to claim 24, wherein the disposable ink cartridge is installed in the printhead chamber of the printhead and secured by the assembly-securement member, and wherein the lower end face of the at least one sealing member is in contact with the printhead to provide a reliable seal.

26. A disposable ink cartridge according to claim 1, wherein the assembly-securement member has at least one cartridge-claw integrated with the cartridge housing.

27. A disposable ink cartridge according to claim 26, wherein the cartridge-claw has at least one locking-tab to match an external frame edge of the printhead to form a fixed structure which is in a form of a rotating arm and which is installed or removed together with the ink cartridge body.

28. A segregated printhead-ink cartridge for use in a printer comprising a printhead having a printhead chamber and a disposable ink cartridge according to claim 27, wherein the disposable ink cartridge is installed in the printhead chamber of the printhead and secured by the assembly-securement member, and wherein the lower end face of the at least one sealing member is in contact with the printhead to provide a reliable seal.

29. A disposable cartridge according to claim 27, wherein the lower end face of the sealing member is without a raised sealing ring.

30. A segregated printhead-ink cartridge for use in a printer comprising a printhead having a printhead chamber and a disposable ink cartridge according to claim 29, wherein the disposable ink cartridge is installed in the printhead chamber of the printhead and secured by the assembly-securement member, and wherein the lower end face of the at least one sealing member is in contact with the printhead to provide a reliable seal.

31. A segregated printhead-ink cartridge for use in a printer comprising a printhead having a printhead chamber and a disposable ink cartridge according to claim 26, wherein the disposable ink cartridge is installed in the printhead chamber of the printhead and secured by the assembly-securement member, and wherein the lower end face of the at least one sealing member is in contact with the printhead to provide a reliable seal.

32. A disposable cartridge according to claim 26, wherein the lower end face of the sealing member is without a raised sealing ring.

33. A segregated printhead-ink cartridge for use in a printer comprising a printhead having a printhead chamber and a disposable ink cartridge according to claim 32, wherein the disposable ink cartridge is installed in the printhead chamber of the printhead and secured by the assembly-securement member, and wherein the lower end face of the at least one sealing member is in contact with the printhead to provide a reliable seal.

34. A disposable cartridge according to claim 1, wherein the lower end face of the sealing member is without a raised sealing ring.

35. A segregated printhead-ink cartridge for use in a printer comprising a printhead having a printhead chamber and a disposable ink cartridge according to claim 34, wherein the disposable ink cartridge is installed in the printhead chamber of the printhead and secured by the assembly-securement member, and wherein the lower end face of the at least one sealing member is in contact with the printhead to provide a reliable seal.

36. A segregated printhead-ink cartridge for use in a printer comprising a printhead having a printhead chamber and a disposable ink cartridge according to claim 1, wherein the disposable ink cartridge is installed in the printhead chamber of the printhead and secured by the assembly-securement member, and wherein the lower end face of the at least one sealing member is in contact with the printhead to provide a reliable seal.

37. In combination, an all-in-one printhead-ink cartridge having a printhead and a non-removable ink cartridge, the non-removable ink cartridge being unremovably connected to and within the printhead so as to be installed or removed together with the printhead; and a disposable ink cartridge for being installed in the all-in-one printhead-ink cartridge, wherein from a printhead chamber formed inside the printhead of the all-in-one printhead-ink cartridge, any cover and ink-absorbent materials have been removed, the disposable ink cartridge comprising:

an assembly-securement member;

an ink cartridge body, the ink cartridge body comprising a cartridge housing, a cartridge cover, at least one air vent cover, at least one ink-storing foam, at least one ink-filtering foam, and at least one sealing member, which are integrated into one indivisible entity, the ink cartridge body being adapted to be installed in the printhead chamber of the printhead to transform the all-in-one printhead-ink cartridge into an assembled segregated printhead-ink cartridge for use in a printer, the ink cartridge body being secured by the assembly-securement member to be connected to the print head and reciprocatingly moving along with the printhead, the at least one sealing member being fixed on a side of the ink cartridge body, being used to seal around an ink outlet of the ink cartridge body and having an elastic sleeve structure with stepped apertures, with an upper sleeve wall tightly pressed into a groove surrounding the ink outlet of the ink cartridge body by means of interference fit between an upper end face of the sealing member and the ink cartridge body to maintain a continuous sealing condition between the sealing member, the ink cartridge body and a lower end face of the sealing member, the lower end face having a flat surface structure adapted to provide a reliable seal when tightly contacting the printhead, so that the ink outlet of the ink cartridge body is directly connected to the printhead; and a cartridge seal holder used to seal the ink outlet of the ink cartridge body before the ink cartridge body is installed in the printhead chamber of the printhead, so that the at least one sealing member seals an end surface of the ink outlet both before and after the ink cartridge body is installed in the printhead chamber of the printhead.

* * * * *